US006264366B1

(12) United States Patent
Custer

(10) Patent No.: US 6,264,366 B1
(45) Date of Patent: Jul. 24, 2001

(54) RECLOSABLE CLOSURE ARRANGEMENT HAVING ENCAPSULATED ZIPPER CLOSURE, RECLOSABLE PROFILES, AND SLIDER DEVICE; AND METHODS

(75) Inventor: Richard G. Custer, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/564,629

(22) Filed: May 4, 2000

Related U.S. Application Data

(60) Provisional application No. 60/134,282, filed on May 14, 1999.

(51) Int. Cl.[7] ..... B65D 33/16

(52) U.S. Cl. ..... 383/5; 383/61; 383/64; 383/203; 383/210; 24/400

(58) Field of Search ..... 383/5, 61, 63, 383/202, 203, 210, 64; 24/399, 400

(56) References Cited

U.S. PATENT DOCUMENTS

| | | | | |
|---|---|---|---|---|
| 2,994,469 | * | 8/1961 | Troup et al. | 383/64 X |
| 3,181,583 | * | 5/1965 | Lingenfelter | 383/203 |
| 4,335,817 | | 6/1982 | Bahr . | |
| 4,713,839 | * | 12/1987 | Peppiatt | 383/61 X |
| 4,896,775 | * | 1/1990 | Boeckmann et al. | 383/64 X |
| 4,925,316 | * | 5/1990 | Van Erden et al. | 383/61 |
| 4,927,271 | | 5/1990 | Branson . | |
| 5,024,537 | * | 6/1991 | Tilman | 383/61 X |
| 5,063,069 | * | 11/1991 | Van Erden et al. | 383/63 X |
| 5,167,608 | * | 12/1992 | Steffens, Jr. et al. | 383/202 X |
| 5,211,482 | * | 5/1993 | Tilman | 383/202 |
| 5,456,928 | * | 10/1995 | Hustad et al. | 383/5 X |
| 5,461,845 | | 10/1995 | Yeager . | |
| 5,480,230 | * | 1/1996 | May | 383/66 X |
| 5,636,783 | * | 6/1997 | Preston | 383/64 X |
| 5,669,715 | * | 9/1997 | Dobreski et al. | 383/5 |
| 5,713,669 | | 2/1998 | Thomas et al. . | |
| 5,875,611 | * | 3/1999 | Plourde | 383/61 X |
| 5,902,047 | * | 5/1999 | Yeager | 383/66 X |
| 5,911,508 | * | 6/1999 | Dobreski et al. | 383/5 |
| 5,964,532 | * | 10/1999 | St. Phillips et al. | 383/64 X |

FOREIGN PATENT DOCUMENTS

| | | | | |
|---|---|---|---|---|
| 0485741 | * | 5/1992 | (EP) | 383/61 |
| 0528721 | * | 2/1993 | (EP) | 383/61 |
| 093011051 | * | 6/1993 | (WO) | 383/202 |

* cited by examiner

*Primary Examiner*—Jes F. Pascua

(57) ABSTRACT

Reclosable closure arrangements suitable for use with packages, such as food and non-food packages, include a zipper closure having mating closure profiles that are releasably engageable with each other, a slider device to open and close the profiles, and a tamper evident-structure. In some embodiments, the tamper evident-structure is positioned between the zipper closure and the slider device. In other embodiments, the tamper evident-structure is positioned over the zipper closure and the slider device. The tamper evident-structure may be a variety of constructions, such as an encapsulating layer. The tamper-evident structures may include structures such as peel seals, areas of weakness, and solid folds.

25 Claims, 11 Drawing Sheets

RECLOSABLE CLOSURE ARRANGEMENT HAVING ENCAPSULATED ZIPPER CLOSURE, RECLOSABLE PROFILES, AND SLIDER DEVICE; AND METHODS

This application claims the benefit of U.S. Provisional Application No. 60/134,282, filed May 14, 1999.

FIELD OF THE INVENTION

The present invention generally relates to closure arrangements for packages. In particular, the present invention relates to closure arrangements having encapsulated zippers, reclosable profiles, and slider devices to open and close the profiles.

BACKGROUND

Many packaging applications use resealable containers to store various types of articles and materials. These packages may be used to store and ship food products, non-food consumer goods, medical supplies, waste materials, and many other articles.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Some perishable goods are sold to consumers in the form of a reclosable package. For example, cheese or meat products can be packaged in a bag with reclosable closure profiles such that after opening the package, it can be reclosed. It is desirable that these packages be hermetically sealed to prevent spoilage. It is also desirable that these packages include tamper-evident features to inform the consumer whether the package previously has been opened.

WO 98/05567 to St. Phillips et al., incorporated herein by reference, shows the use of a one-time breakable preferential area of weakness and reclosable profiles on a package.

U.S. Pat. No. 4,782,951 to Griesbach et al., incorporated herein by reference, shows the use of a peel seal and reclosable profiles on a package.

Other U.S. Patents show the use of a peel seal in combination with reclosable profiles. Some of these patents include U.S. Pat. No. 4,925,316 to VanErden et al.; U.S. Pat. No. 4,923,309 to VanErden et al.; U.S. Pat. No. 5,456,928 to Hustad et al.; U.S. Pat. No. 5,425,825 to Rasko et al.; and U.S. Pat. No. 5,733,636 to May; each of these patents being incorporated herein by reference.

Encapsulated zippers also are disclosed in U.S. Patents. Examples include U.S. Pat. No. 4,335,817 to Bahr; U.S. Pat. No. 4,927,271 to Branson; and U.S. Pat. No. 5,713,669 to Thomas et al; each of these patents being incorporated herein by reference.

Improvements in closure arrangements are desirable.

SUMMARY OF THE DISCLOSURE

The present disclosure describes closure arrangements for reclosable packages. In one embodiment, a reclosable package includes a closure arrangement having a zipper closure, a slider device, and an encapsulating layer positioned between the zipper and the slider device. The zipper includes first and second closure profiles that are releasably engageable with each other. The encapsulating layer includes a tamper-evident structure. In one embodiment, the tamper-evident structure is an area of weakness. In another embodiment, the tamper-evident structure is a solid fold.

In another embodiment, a reclosable package includes a closure arrangement having a zipper closure, an encapsulating layer, and a slider device positioned between the zipper and the encapsulating layer. The encapsulating layer includes a tamper-evident structure. In one embodiment, the tamper-evident structure is a peel seal. In another embodiment, the tamper-evident structure is a solid fold. In still another embodiment, the tamper-evident structure is an area of weakness.

The encapsulating layer may be a variety of constructions. In one embodiment, the encapsulating layer includes a panel extended portion. In another embodiment, the encapsulating layer includes an independent panel section. In still another embodiment, the encapsulating layer includes two panel extender sections.

The slider device is constructed and arranged to slide relative to the zipper to control interlocking and disengaging between the first and second closure profiles.

In some embodiments, the packages may be hermetically sealed.

DETAILED DESCRIPTION

Figure 1:
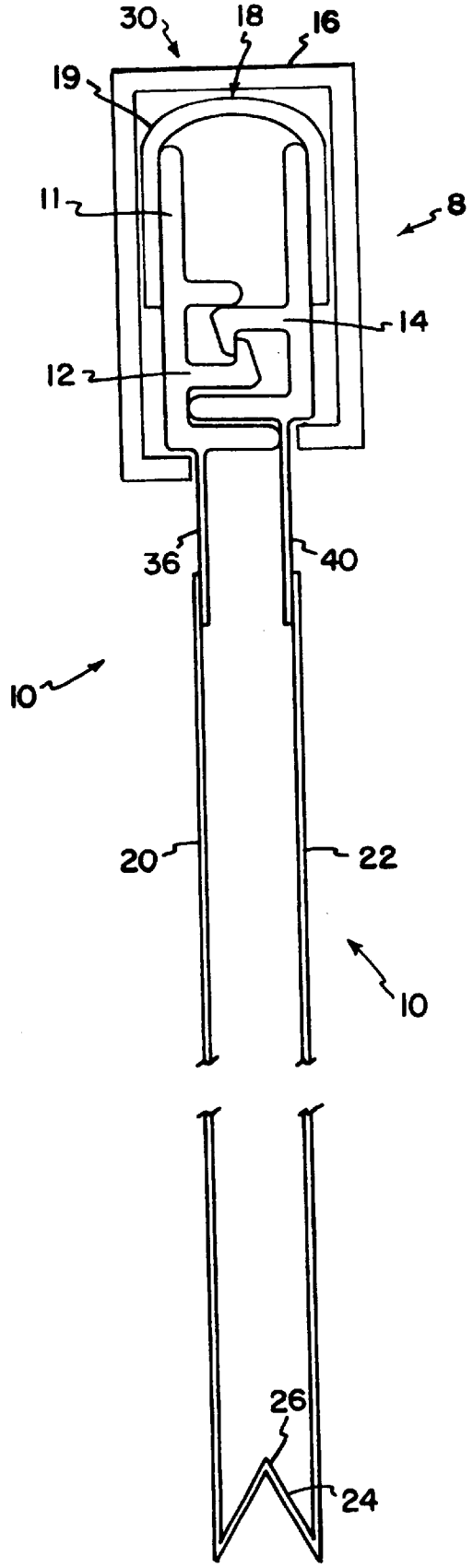
FIG. 1 is a schematic, cross-sectional, fragmented view of a first embodiment of a flexible, reclosable package having a closure arrangement with a zipper closure, a slider device, and an encapsulating layer, constructed according to principles of this disclosure.
Figure 2:
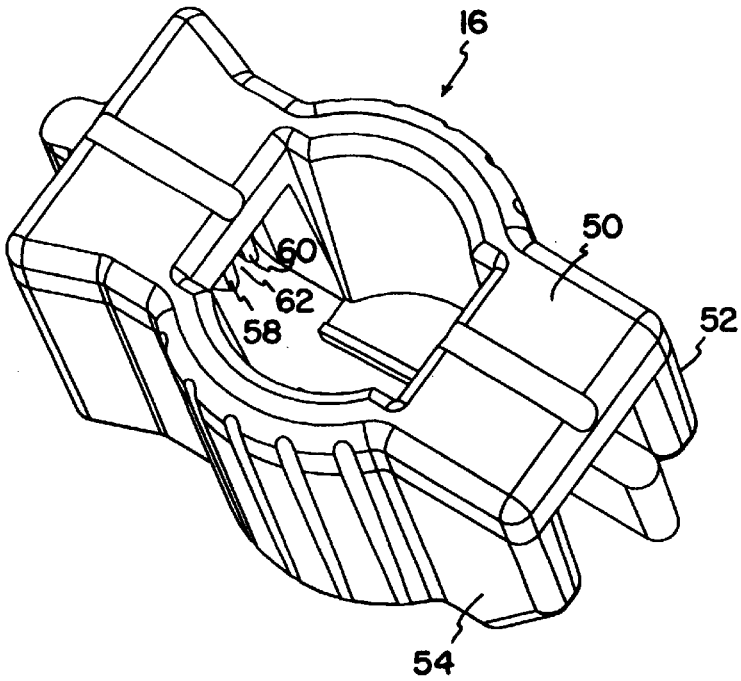
FIG. 2 is an enlarged, perspective view of one embodiment of a slider device suitable for use with the closure arrangement of FIG. 1.
Figure 3:
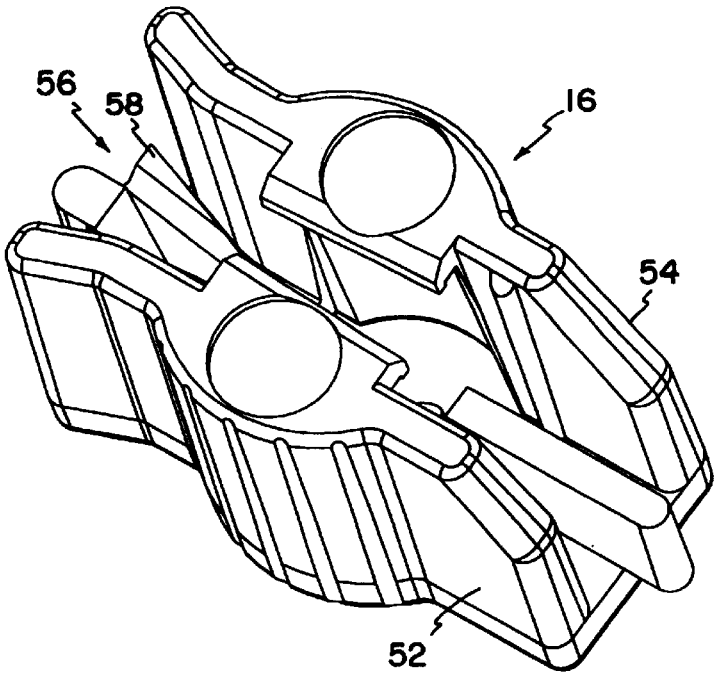
FIG. 3 is another perspective view of the slider device depicted in FIG. 2.

Attention is directed to FIG. 1, which illustrates a schematic, cross-sectional view of an example packaging arrangement in the form of a resealable, flexible package 10 having a closure arrangement 8. In the illustrated embodiment, the closure arrangement 8 includes a zipper closure 11 having first and second closure profiles 12, 14; a slider device 16 to open and close the profiles 12, 14; and an encapsulating layer 19 with a tamper-evident structure 18.

The flexible package 10 includes first and second opposed panel sections 20, 22 made from a flexible, polymeric film. For some manufacturing applications, the first and second panel sections 20, 22 are heat sealed together along two edges and meet at fold panel 24 opposite the zipper closure to form a three-edged containment section for retaining a product within the interior of the package 10. The fold panel 24 comprises a fold seam 26. Such a construction is often referred to as a "gusset". Alternatively, two separate panel sections 20, 22 of polymeric film may be used and heat sealed together along the two edges and at the fold seam 26. Access is provided to the interior of the package 10 through a mouth 30.

The slider device 16 is operably mounted on closure profiles 12, 14 and can include a variety of configurations and structures. One particular example of a suitable slider device 16 is illustrated in more detail in FIGS. 2–5. The slider device 16 includes a top wall 50 and a pair of side walls 52, 54 extending from the top wall 50 such that the walls 52, 54 form a generally C-shaped channel. The slider device 16 also includes a spreader or plow 56 extending or projecting from the wall 50. In the embodiment illustrated, the plow 56 comprises first and second angled wedges 58, 60 separated by a gap 62. Slider devices and how they function to open and close zipper closures, in general, are taught, for example, in U.S. Pat. Nos. 5,063,644; 5,301,394; 5,442,837, and 5,664,229, each of which is incorporated by reference herein. A preferred slider device is taught in U.S. patent applications Ser. Nos. 09/365,215 and 29/108,657, both filed Jul. 30, 1999 and incorporated herein by reference in their entirety.

Figure 4:
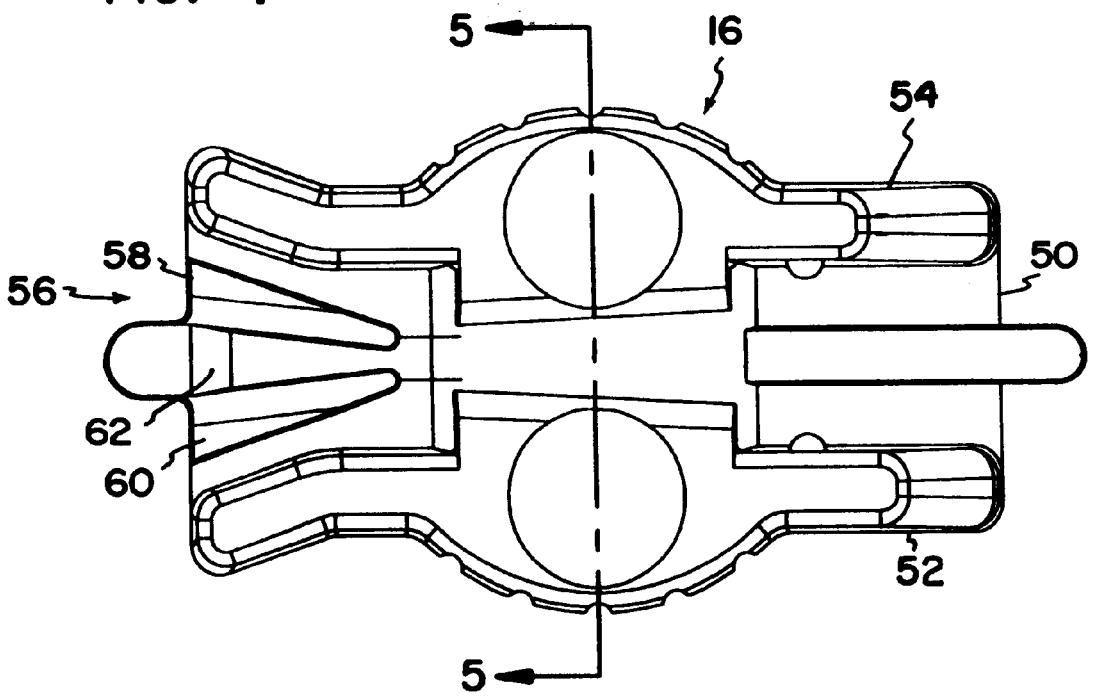
FIG. 4 is bottom plan view of the slider device depicted in FIG. 2.
Figure 5:
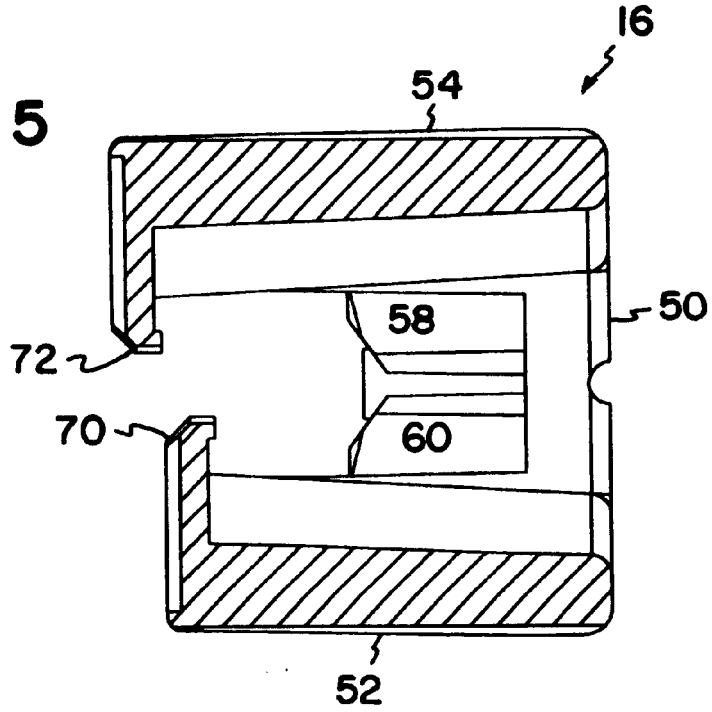
FIG. 5 is a cross-sectional view of the slider device depicted in FIGS. 2–4 taken along the line 5—5 of FIG. 4.

FIG. 5 illustrates a cross-section taken along line 5—5 of FIG. 4. First and second hook constructions 70, 72 are viewable in FIG. 5. First and second hook constructions 70, 72 help permit the slider device 16 to slide along the zipper closure 11 without becoming disengaged from zipper closure 11 and from package 10.

The zipper closure 11 can include a variety of configurations and structures. For example, the zipper closure 11 can be constructed according to U.S. Pat. Nos. 4,240,241; 4,246,288; or 4,437,293; each of which is incorporated by reference herein.

In the embodiment shown in FIG. 1, the zipper closure 11 has first and second closure profiles 12, 14. The first and second closure profiles 12, 14 are releasably engageable with each other to provide a reclosable seal to the package. The first profile 12 has a first depending fin or flange 36 extending therefrom, and the second profile 14 has a second depending fin or flange 40 extending therefrom. If the zipper closure 11 is formed separately from the panel sections 20, 22, the first and second fins 36, 40 are typically thermally fused to inner surfaces of the respective first and second panel sections 20, 22. Alternatively, the zipper closure 11 may be extruded together with the panel sections 20, 22 such that the first fin 36 is integrally formed with the first panel section 20 and the second fin 40 is integrally formed with the second panel section 22.

Closure arrangement 8 also includes tamper evident-structure 18. The tamper evident-structure 18 includes an encapsulating layer 19, which extends over, covers, or otherwise encapsulates the closure profiles 12, 14 of zipper closure 11. The tamper-evident structure 18 signals to the consumer whether the package has been opened previously. One advantage of having the tamper-evident structure 18, specifically encapsulating layer 19, encase the zipper closure 11 is that the consumer is able to identify whether the package 10 previously has been opened or otherwise tampered. The tamper evident-structure 18 can cover all of zipper closure 11 or only various portions of it; that is, tamper evident-structure 18 may be intermittent along zipper closure 11.

Figure 6:
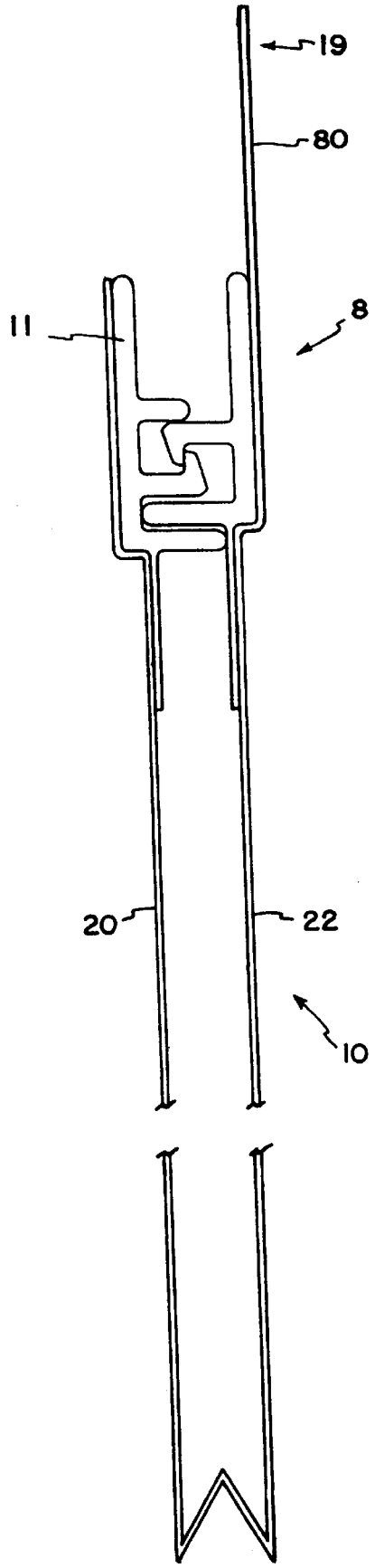
FIG. 6 is a schematic, cross-sectional, fragmented view of the flexible, reclosable package of FIG. 1 prior to encapsulating the zipper closure with the encapsulating layer.

FIG. 6 illustrates the flexible package 10 of FIG. 1 including closure arrangement 8, except that closure arrangement 8 is shown before a tamper evident-structure, such as encapsulating layer 19, is created over zipper closure 11 and before without slider device 16 (FIG. 1) is mounted thereon. FIG. 6 shows the package 10, the zipper closure 11, and first and second opposed panel sections 20, 22. The encapsulating layer 19 can be constructed in a variety of ways. In the particular embodiment illustrated in FIG. 6, the encapsulating layer 19 is an extended portion 80 of the second panel section 22. That is, the encapsulating layer 19 is integrally formed with the second panel section 22. To encapsulate the zipper closure 11, the extended portion 80 is bent over zipper closure 1 1 and secured to the first panel section 20.

Figure 7:
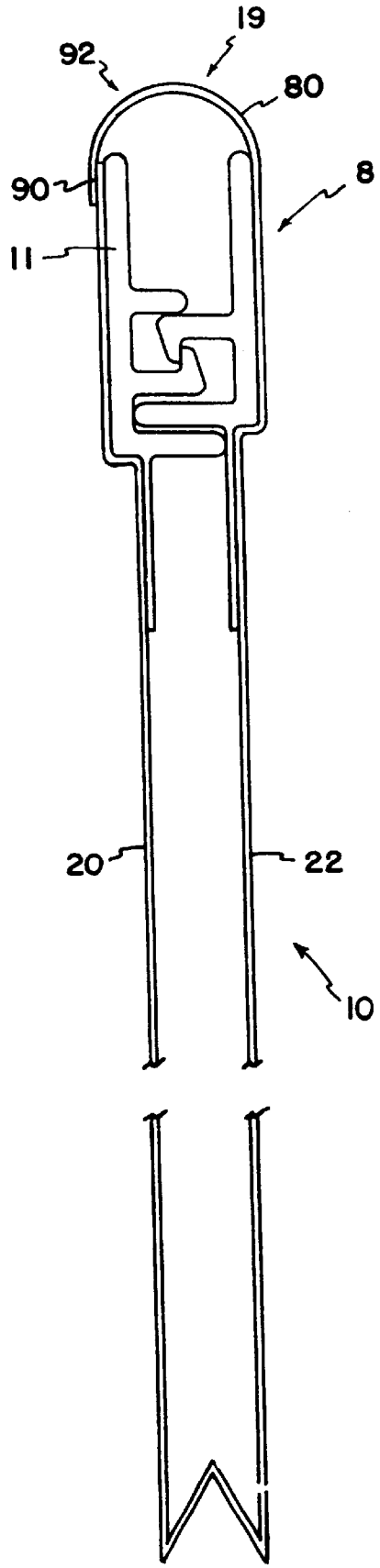
FIG. 7 is the same sectional view as in FIG. 6 after encapsulating the zipper closure.

FIG. 7 illustrates package 10 of FIG. 6 after the tamper evident-structure, specifically encapsulating layer 19, has been secured to the first panel section 20. As illustrated in FIG. 7, the encapsulating layer 19 is secured to the first panel section 20 at an upper portion 90 of first panel section 20; that is, a portion of first panel section 20 that is adjacent to an end 92 opposite the fold panel 24 (FIG. 1) of the package 10.

The encapsulating layer 19 is secured to the first panel section 20 according to known methods, such as, for example, by an added adhesive, a solvent, by a heat seal created by the application of heat and pressure, and the like. In an alternative embodiment, the encapsulating layer 19 may be secured directly to the zipper closure 11 rather than to first panel section 20; in such an embodiment, typically the ends of the encapsulating layer 19 and the panel section 20 will be in close proximity.

Figure 8:
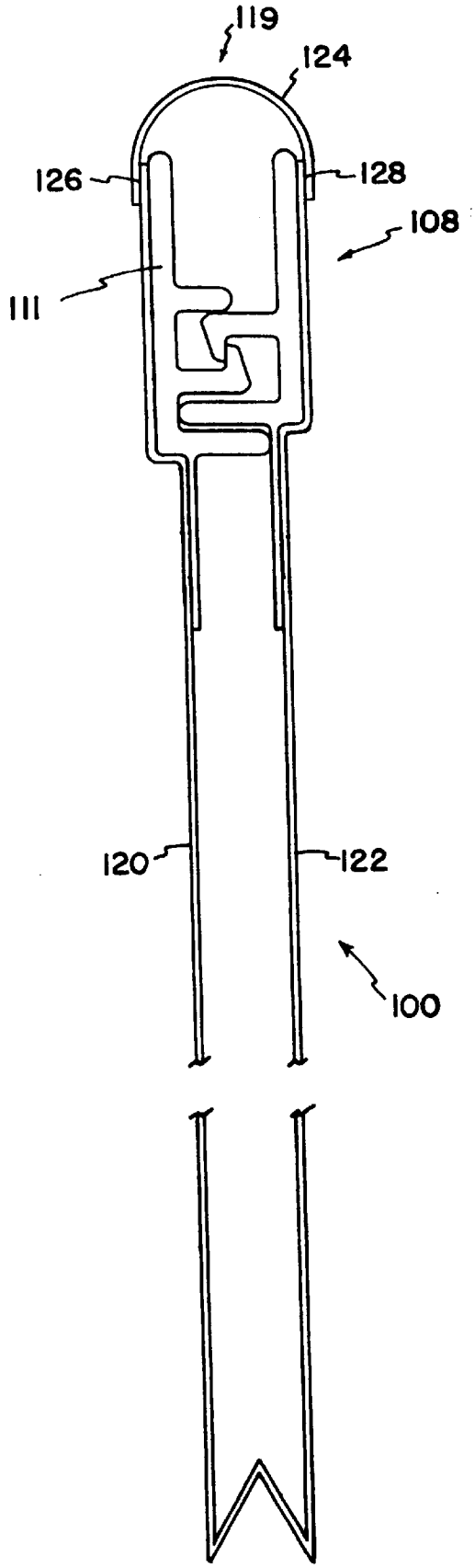
FIG. 8 is a schematic, cross-sectional, fragmented view of another embodiment of a flexible, reclosable package analogous to the view depicted in FIG. 7.
Figure 9:
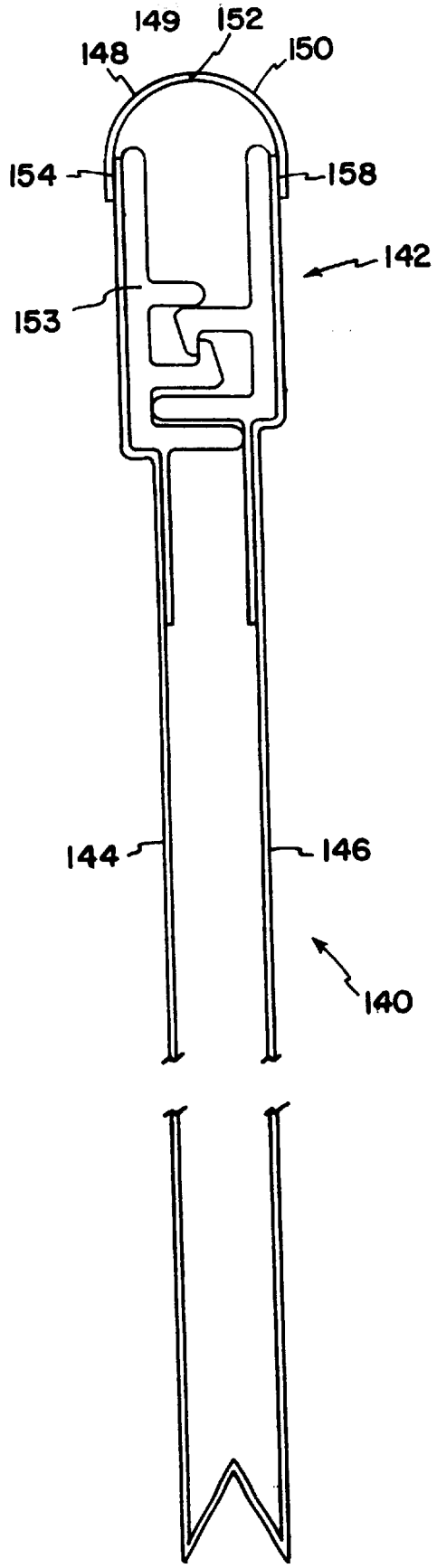
FIG. 9 is a schematic, cross-sectional, fragmented view of another embodiment of a flexible, reclosable package analogous to the view depicted in FIG. 7.
Figure 10:
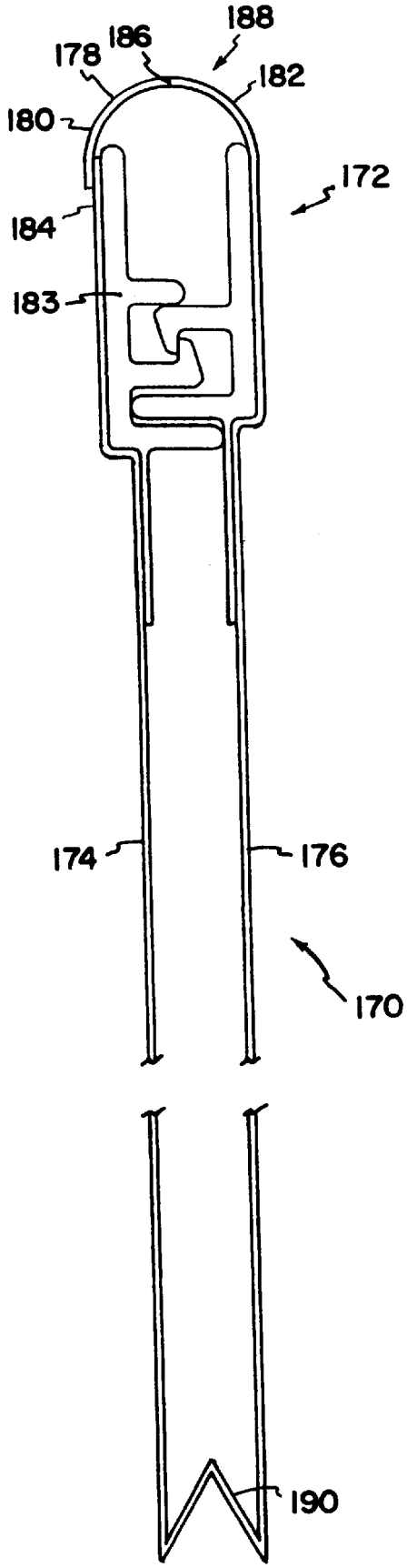
FIG. 10 is a schematic, cross-sectional, fragmented view of another embodiment of a flexible, reclosable package analogous to the view depicted in FIG. 7.

In other embodiments, the encapsulating layer 19 may not be an extension of second panel 22, such as second panel extended portion 80 of FIG. 7. Rather, encapsulating layer 19 can be formed by various different configurations. FIGS. 8–10 illustrate examples of other embodiments.

FIG. 8 shows a flexible package 100 including closure arrangement 108 analogous to the view depicted in FIG. 7. The embodiment of FIG. 8 includes a package 100 having first and second panel sections 120, 122, and a tamper evident-structure, such as encapsulating layer 119, over zipper closure 111. In this embodiment, the encapsulating layer 119 is a separate, discrete piece or independent panel section 124 that is secured to both the first and second opposed panel sections 120, 122 at respective upper portions 126, 128 of the first and second panel sections 120, 122. In this embodiment, the encapsulating layer 119 is not an extended portion of either panel section. Independent or discrete piece 124 is secured to upper portions 126, 128 of panel section 120, 122 by an adhesive, a solvent, heat seal, or the like.

In an alternative embodiment, the discrete piece 124 is secured directly to the zipper closure 111; the ends of discrete piece 124 are proximate to the ends of first and second panel sections 120, 122. In still another embodiment, the discrete piece 124 is secured to the second panel section 122 and directly to the zipper closure 111 proximate the first panel section 120.

FIG. 9 illustrates yet another embodiment of a flexible package 140 including a closure arrangement 142 analogous to the view depicted in FIG. 7. The embodiment in FIG. 9 includes a package 140 having first and second panel sections 144, 146 and a tamper evident-structure, such as encapsulating layer 149, covering zipper closure 153. In this embodiment, the encapsulating layer 149 includes first and second panel extender sections 148, 150; each of first and second panel extender sections 148, 150 is a separate, discrete piece. The first and second panel extender sections 148, 150 are joined or otherwise secured to each other along a seam or line 152 and to respective upper portions 154, 158 of first and second panel sections 144, 146.

In an alternative embodiment, the first and second panel extender sections 148, 150 are secured to each other along the seam 152 and directly to the zipper closure 153 proximate to each of first and second panel sections 144, 146, respectively. In still another embodiment, the first panel extender section 148 is secured to the first panel section 144, the second panel extender section 150 is secured directly to the zipper closure 153 proximate the second panel section 146; the first and second panel extender sections 148, 150 are secured together along the seam 152.

FIG. 10 illustrates yet another embodiment of a flexible package 170 including a closure arrangement 172 analogous to the view depicted in FIG. 7. The embodiment in FIG. 10 includes a package 170 having first and second panel sections 174, 176 and a tamper evident-structure, such as encapsulating layer 178, over zipper closure 183. In this embodiment, the encapsulating layer 178 includes a first panel extender section 180 and a second panel extended portion 182. In this embodiment, the first panel extender section 180 is a discrete membrane or web piece secured to the first panel section 174 at an upper portion 184; that is, first panel extender section 180 is a portion adjacent to an end 188 that is opposite from the fold panel 190 of the package 170. Further, first panel extender section 180 is attached to the second panel extended portion 182 along a seam or line 186. The second panel extended portion 182 is integral with the second panel section 176. A similar embodiment also may be constructed from a first panel extended portion and a second panel extended portion secured along a seam or line. In an alternative embodiment, the first panel extender section 180 is secured directly to the zipper closure 183 proximate the first panel section 174 and to the second panel extended portion 182 along the seam 186.

The tamper evident-structure, such as encapsulating layer 19, 119, 149, 178, can include a variety of constructions to provide tamper evidence. For example, the tamper-evident structure 18 may include a peel seal, an area of weakness, or a solid fold or web that requires cutting to open.

Figure 11:
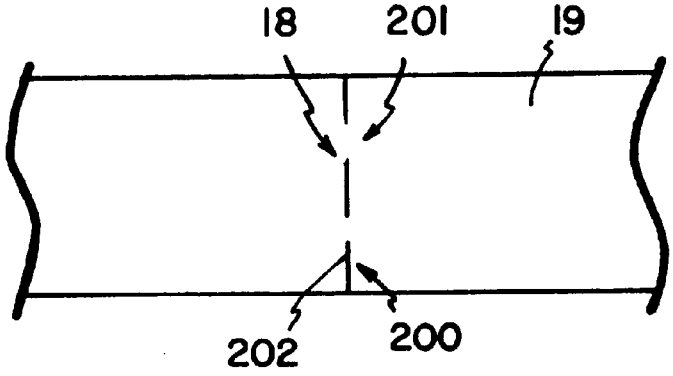
FIG. 11 is a plan view of the encapsulating layer as depicted in FIG. 1.

FIG. 11 illustrates a top plan view of the tamper evident-structure 18 as depicted in FIG. 1, with encapsulating layer 19 but without the slider device 16. In this embodiment, the encapsulating layer 19 has an area of weakness 200. This area of weakness 200 can be a perforated line 202 along a break line 201. In other embodiments, an area of weakness 200 is created by, for example, a scored or thinned line. A scored line is created by making a uniform crease in the tamper evident-structure 18 or encapsulating layer 19 approximately along the break line 201. A thinned line is created by co-extruding the tamper evident-structure 18 with less material in the vicinity along the break line 201. In another embodiment, the area of weakness 200 is created by forming the tamper evident-structure 18 out of a highly oriented material that has a tendency to split along the break line 201.

Figure 12:
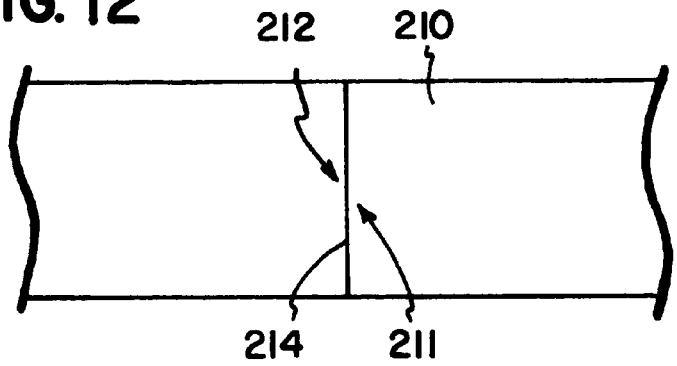
FIG. 12 is a plan view of another embodiment of an encapsulating layer analogous to the view depicted in FIG. 11.

FIG. 12 illustrates a top plan view of another embodiment of a tamper evident-structure 212 having encapsulating layer 210 analogous to tamper evident-structure 18 having encapsulating layer 19 depicted in FIG. 11. In FIG. 12, the tamper-evident structure 212 has a continuous, solid fold 214 formed along the line 211. The solid fold 214 is formed by methods known in the art.

In some embodiments, the tamper evident-structure 18 is constructed from a material suitable for forming a hermetic seal. Such materials are known in the art. Packages having reclosable closure arrangements and encapsulated zippers of the invention may be hermetically sealed by known methods.

Referring again to FIG. 1, to initially open the mouth of the reclosable package 10, the slider device 16 is slid relative to the zipper closure 11 from a position where the first and second closure profiles 12, 14 are interlocked to a position where the first and second closure profiles 12, 14 are disengaged. The method used to disrupt the tamper-evident structure 18 will depend on the type of tamper-evident structure 18 present.

For example, as in the embodiment shown in FIG. 11, when the tamper-evident structure 18 has area of weakness 200 created by perforated line 202, the area of weakness 200 will be disrupted by pulling the first and second panel sections 20, 22 (FIG. 1) in directions opposite each other by applying a force pushing or punching down the area of weakness 200 toward the product contained within the package 10; alternately, the area of weakness 200 can be cut. Another example, such as in FIG. 12, when the tamper-evident structure 212 is a solid fold 214, the fold 214 may be disrupted by cutting the fold 214.

The closure arrangement can be manufactured using conventional extrusion and heat sealing techniques.

Figure 13:
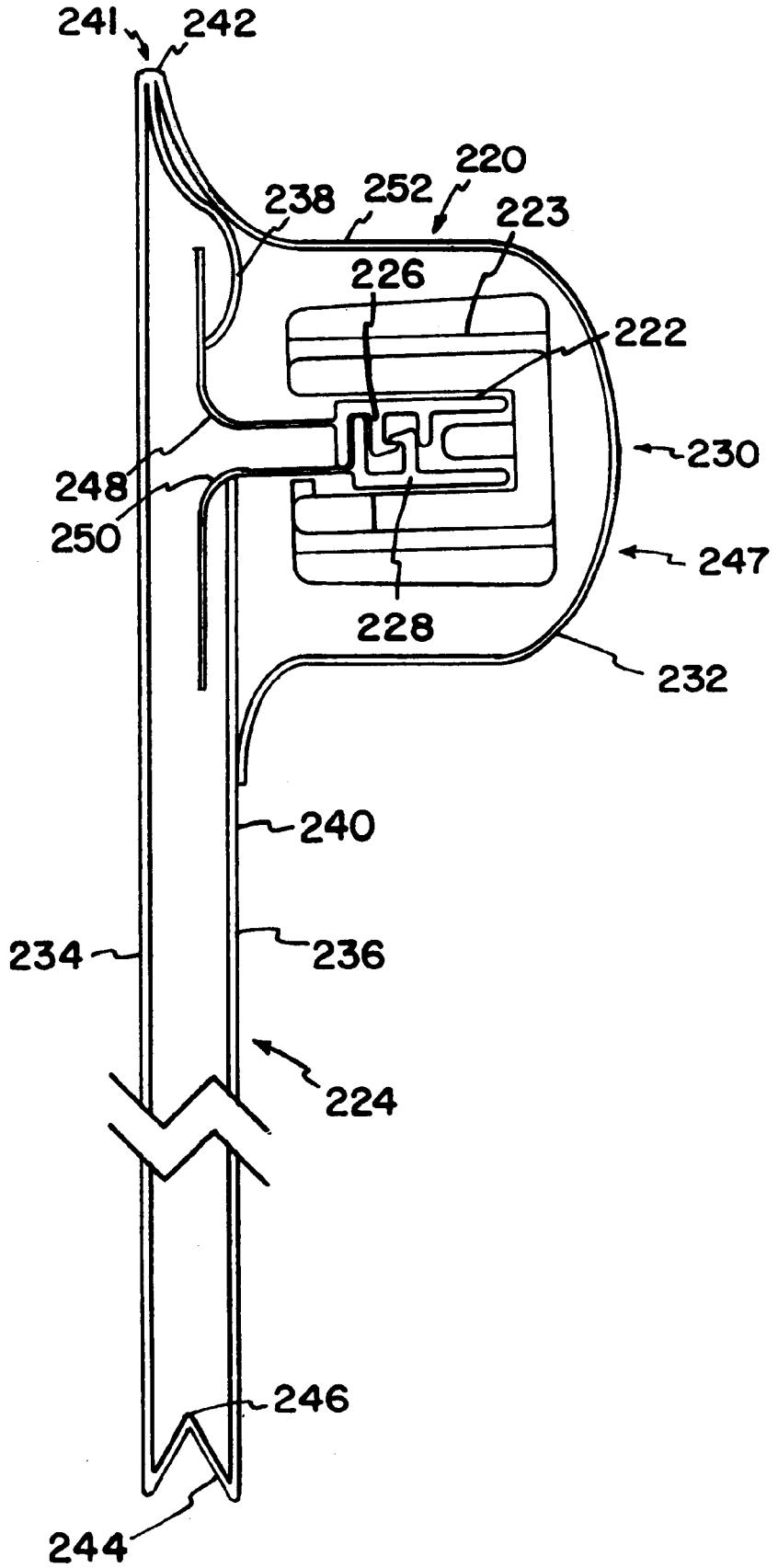
FIG. 13 is a schematic, cross-sectional, fragmented view of another embodiment of a flexible, reclosable package having a closure arrangement with a zipper closure, a slider device, and an encapsulating layer, constructed according to principles of this disclosure.

Another embodiment of a closure arrangement 220 having an encapsulated zipper closure 222 is illustrated in FIG. 13. FIG. 13 illustrates a schematic, cross-sectional, fragmented view of another example of a packaging arrangement in the form of a resealable, flexible package 224 having a closure arrangement 220. In the illustrated embodiment, the closure arrangement 220 includes a zipper closure 222 having first and second closure profiles 226, 228; a slider device 223 to open and close the profiles 226, 228; and a tamper evident-structure 230 with encapsulating layer 232.

The flexible package 224 includes first and second opposed panel sections 234, 236 made from a flexible, polymeric film. The second panel section 236 includes both a second upper panel section 238 (i.e., a portion adjacent to an end that is opposite from the bottom fold panel 244) and a second lower panel section 240 (i.e., a portion adjacent to the bottom fold panel 244). For some manufacturing applications, the first and second panel sections 234, 236 are heat sealed together along two edges and meet at an upper fold panel 241 including an upper fold seam 242, and a bottom fold panel 244 including a bottom fold seam 246 (i.e., the upper fold panel 241 is at an opposite end from the bottom fold panel 244). A mouth 247, providing access to the interior of package 224, is positioned within the second panel section 236 between second upper panel section 238 and second lower panel section 240.

As described for the embodiment in FIG. 1, a variety of slider devices, such as, for example, the slider device 16 illustrated in FIGS. 2–5, may be used with the closure arrangement 220. Similarly, a variety of zipper closure configurations also may be used.

To open and gain access to the interior of the various package constructions described above, the tamper evident-structure, particularly the encapsulating layer, must be broken, penetrated or other breached. This is generally done by breaching the construction, such as the areas of weakness 200 defined by perforation 202 of FIG. 11 or by fold 214. This breaching can be done by cutting, tearing, ripping, slicing, or other activity that would penetrate the tamper evident-structure. Once the tamper evident-structure has been disabled, the slider device 16 is accessible and can be moved along zipper closure in order to unmate the first and second closure profiles. This will allow access to the interior of the package.

In the embodiment shown in FIG. 13, the zipper closure 222 has first and second closure profiles 226, 228. The first and second closure profiles 226, 228 are releasably engageable with each other to provide a reclosable seal to the package 224. The first closure profile 226 has a first depending fin or flange 248 extending therefrom, and the second closure profile 228 has a second depending fin or flange 250 extending therefrom. If the zipper closure 222 is formed separately from the second upper and lower panel sections 238, 240, the first and second fins 248, 250 typically are thermally fused to inner surfaces of the respective upper and lower panel sections 238, 240. Alternatively, the zipper closure 222 can be extruded with the upper and lower panel sections 238, 240 with the first fin 248 integrally formed with the upper panel section 238, and the second fin 250 integrally formed with the second panel section 240.

The tamper evident-structure 230, such as encapsulating layer 232, encapsulates or covers the zipper closure 222 and the slider device 223. In this embodiment, the encapsulating layer 232 is a discrete, separate piece or independent panel section 252 that is secured to each of the second upper and lower panel sections 238, 240. In an alternative embodiment, the discrete piece 252 may be secured directly to the zipper closure 222 proximate the second upper and lower panel sections 238, 240. In still another embodiment, the discrete piece 252 may be secured to the second lower panel section 240 and to the zipper closure 222 adjacent to the second upper panel section 238. Similarly, in another embodiment, the discrete piece 252 may be secured to the second upper panel section 238 and to the zipper closure 222 proximate the second lower panel section 240.

In other embodiments, the encapsulating layer 232 need not be the independent panel section 252. Rather, as described above for FIGS. 7–10, the encapsulating layer 232 may have any of a variety of constructions. For example, the encapsulating layer 232 may include a second upper panel section extended portion; a second lower panel extended portion; an upper panel extender section and a lower panel extender section; a lower panel extended portion and an upper panel extender section; an upper panel extended portion and a lower panel extended portion; and the like.

The tamper-evident structure 230 can be a variety of constructions. As illustrated in FIGS. 11–12, the tamper-evident structure 230 may be constructed to include an area of weakness or a solid fold. Moreover, in the embodiment shown in FIG. 13, the tamper-evident structure 230 may also include a peel seal construction.

Figure 14:
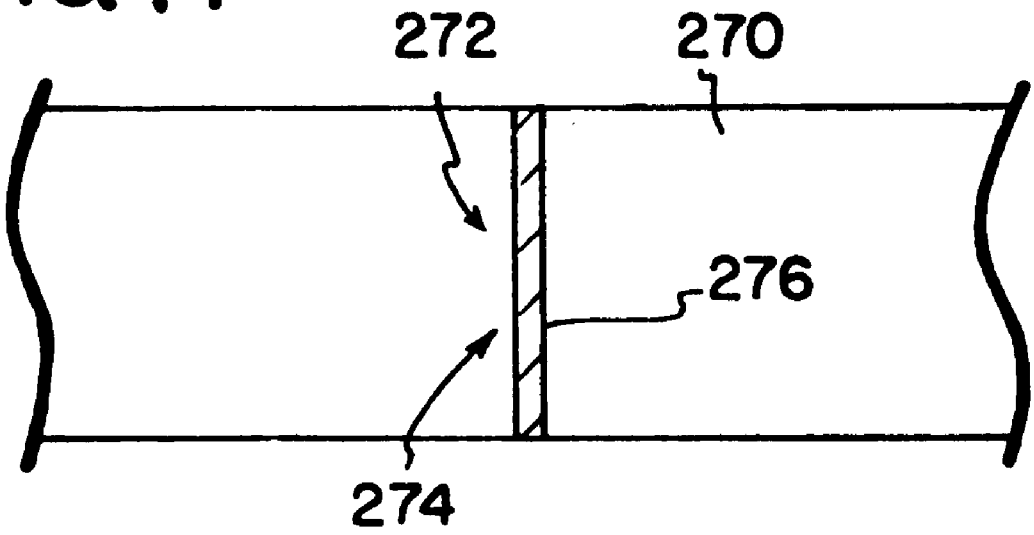
FIG. 14 is a plan view of an encapsulating layer analogous to the encapsulating layer depicted in FIG. 13.

FIG. 14 illustrates a plan view of a tamper evident-structure 274 having encapsulating layer 270 analogous to the tamper evident-structure 230 with encapsulating layer 232 depicted in FIG. 13. In this embodiment, tamper-evident structure 274 includes a peel seal 276 formed along a line 272. The peel seal 276 is formed by methods known in the art.

In some embodiments, the tamper evident-structure 230, 274 is constructed from a material suitable for forming a hermetic seal. Such materials are known in the art. Packages having reclosable closure arrangements and encapsulated zippers of the invention may be hermetically sealed by known methods.

The above specification and examples are believed to provide a complete description of the manufacture and use of particular embodiments of the invention. Many embodiments of the invention can be made.

What is claimed:

1. A reclosable package, comprising:

(a) first and second opposed panel sections secured together and defining a mouth;

(b) a zipper closure extending along said mouth, said zipper closure having first and second closure profiles; said first and second closure profiles being releasably engageable with each other;

(c) a slider device operably mounted on said zipper closure, said slider device configured and constructed to slide relative to said zipper closure to control interlocking and disengaging of said first and second closure profiles; and (d) a tamper evident-structure comprising an encapsulating layer, said encapsulating layer positioned between said zipper closure and said slider device;

(i) said encapsulating layer comprising a second panel portion having a first end and a second end, said second panel portion integral with said second panel section at said first end and secured to said first panel section at said second end.

2. The reclosable package according to claim 1, wherein said tamper-evident structure comprises a solid fold.

3. The reclosable package according to claim 1, wherein said tamper-evident structure comprises an area of weakness.

4. The reclosable package according to claim 3, wherein said area of weakness comprises a perforation.

5. The reclosable package according to claim 1, further including a bottom gusset.

6. The reclosable package according to claim 1, wherein said encapsulating layer covers a portion of said zipper closure.

7. The reclosable package according to claim 6, wherein said encapsulating layer extends along the length of said zipper closure.

8. A method of making a reclosable package comprising:

(a) providing a first panel section and a second panel section, said first panel section and said second panel section defining a package interior;

(b) providing a zipper closure having a first closure profile and a second closure profile, each of said first closure profile and said second closure profile comprising a flange;

(c) providing an encapsulating layer covering said first closure profile and said second closure profile at an end opposite said flanges;

(i) the encapsulating layer being integral with the first panel section and being attached to the second closure profile;

(d) mounting a slider device onto said zipper closure over said encapsulating layer; and (e) sealing said first closure profile flange and said second closure profile flange to said first panel section and said second panel section.

9. A method of opening a reclosable package, the package comprising first and second panel section, a mouth positioned in the first panel section, a zipper closure having a slider device mounted thereon extending along the mouth, and a tamper evident-structure extending between the zipper closure and the slider device, the tamper evident structure comprising a second panel portion having a first end and a second end, the second panel portion being integral with the second panel section at the first end and secured to said first panel section at the second end; the method comprising:

(a) breaching the tamper evident-structure to expose the zipper closure; and (b) moving the slider device in a first direction to open the exposed zipper closure.

10. The method according to claim 9, wherein the step of breaching the tamper evident-structure to expose the zipper closure comprises:

(a) breaching the tamper evident-structure by tearing a perforation.

11. The method according to claim 9, wherein the step of breaching the tamper evident-structure to expose the zipper closure comprises:

(a) breaching the tamper evident-structure by breaking a peel seal.

12. The method according to claim 9, wherein the step of moving the slider device in a first direction to open the exposed zipper closure comprises:

(a) moving the slider device in a first direction to unmate a first closure profile from a second closure profile.

13. A reclosable package comprising:

(a) first and second opposed panel sections secured together and defining a mouth;

(b) a zipper closure extending along said mouth, said zipper closure having first and second closure profiles; said first and second closure profiles being releasably engageable with each other;

(c) a slider device operably mounted on said zipper closure, said slider device configured and constructed to slide relative to said zipper closure to control interlocking and disengaging of said first and second closure profiles; and (d) a tamper evident-structure comprising an encapsulating layer, said encapsulating layer positioned between said zipper closure and said slider device;

(i) said encapsulating layer including a discrete panel section having a first end and a second end, said discrete panel section being secured to said first panel section at said first end and to said second panel section at said second end.

14. The reclosable package according to claim 13, wherein said tamper-evident structure comprises a solid fold.

15. The reclosable package according to claim 13, wherein said tamper-evident structure comprises an area of weakness.

16. The reclosable package according to claim 13, further including a bottom gusset.

17. A reclosable package comprising:

(a) first and second opposed panel sections secured together and defining a mouth;

(b) a zipper closure extending along said mouth, said zipper closure having first and second closure profiles; said first and second closure profiles being releasably engageable with each other;

(c) a slider device operably mounted on said zipper closure, said slider device configured and constructed to slide relative to said zipper closure to control interlocking and disengaging of said first and second closure profiles; and (d) a tamper evident-structure comprising an encapsulating layer, said encapsulating layer positioned between said zipper closure and said slider device;

(i) said encapsulating layer including a first panel portion and a second panel portion, each of said first panel portion and said second panel portion having a first end and a second end;

(ii) said first panel portion being secured to said first panel section at said first end of said first panel portion;

(iii) said second panel portion being secured to said second panel section at said second end of said second panel portion; and (iv) said first panel portion and said second panel portion being secured together along a seam between said first panel portion second end and said second panel portion first end.

18. The reclosable package according to claim 17, wherein said tamper-evident structure comprises an area of weakness.

19. The reclosable package according to claim 17, further including a bottom gusset.

20. The reclosable package according to claim 17, wherein said encapsulating layer extends along the length of said zipper closure.

21. A reclosable package comprising:

(a) first and second opposed panel sections secured together and defining a mouth;

(b) a zipper closure extending along said mouth, said zipper closure having first and second closure profiles; said first and second closure profiles being releasably engageable with each other;

(c) a slider device operably mounted on said zipper closure, said slider device configured and constructed to slide relative to said zipper closure to control interlocking and disengaging of said first and second closure profiles; and (d) a tamper evident-structure comprising an encapsulating layer, said encapsulating layer positioned between said zipper closure and said slider device;

(i) said tamper evident-structure including said first panel and said second panel secured together along a seam.

22. The reclosable package according to claim 21, wherein said tamper-evident structure comprises an area of weakness.

23. The reclosable package according to claim 21, further including a bottom gusset.

24. A method of making a reclosable package comprising:

(a) providing a first panel section and a second panel section, said first panel section and said second panel section defining a package interior;

(b) providing a zipper closure having a first closure profile and a second closure profile, each of said first closure profile and said second closure profile comprising a flange;

(c) providing an encapsulating layer covering said first closure profile and said second closure profile at an end opposite said flanges;

(i) the encapsulating layer comprising a first panel portion and a second panel portion; the first panel portion being integral with the first panel section; the second panel portion being integral with the second panel section;

(ii) the first panel portion and the second panel portion being sealed to each other;

(d) mounting a slider device onto said zipper closure over said encapsulating layer; and (e) sealing said first closure profile flange and said second closure profile flange to said first panel section and said second panel section.

25. A method of making a reclosable package comprising:

(a) providing a first panel section and a second panel section, said first panel section and said second panel section defining a package interior;

(b) providing a zipper closure having a first closure profile and a second closure profile, each of said first closure profile and said second closure profile comprising a flange;

(c) providing an encapsulating layer covering said first closure profile and said second closure profile at an end opposite said flanges;

(i) the encapsulating layer comprising a first layer section and a second layer section; the first layer section being attached to the first panel section and to the second layer section; and the second layer section being attached to the second panel section and to the first layer section;

(d) mounting a slider device onto said zipper closure over said encapsulating layer; and (e) sealing said first closure profile flange and said second closure profile flange to said first panel section and said second panel section.

* * * * *